United States Patent [19]

Zeisky

[11] 4,436,053

[45] Mar. 13, 1984

[54] CLIP-ON BOOKMARK

[76] Inventor: Andre L. Zeisky, 55 W. 14th St., New York, N.Y. 10011

[21] Appl. No.: 292,282

[22] Filed: Aug. 12, 1981

[51] Int. Cl.[3] ..... B42D 9/00

[52] U.S. Cl. ..... 116/237; 281/45

[58] Field of Search ..... 116/234, 237, 238, 239, 116/236; 281/46, 50, 45, 47

[56] References Cited

U.S. PATENT DOCUMENTS

| | | | |
|---|---|---|---|
| 229,626 | 7/1880 | McCalmont | 116/237 |
| 1,385,991 | 8/1921 | French | 116/238 |
| 1,476,743 | 12/1923 | Walker | 116/238 |
| 2,631,560 | 3/1953 | Myers | 116/237 |
| 3,140,883 | 7/1964 | Anthony | 116/236 |
| 4,072,407 | 2/1978 | Zeisky | 116/235 |

FOREIGN PATENT DOCUMENTS

| | | | |
|---|---|---|---|
| 252059 | 5/1926 | United Kingdom | 281/50 |

*Primary Examiner*—Charles E. Frankfort
*Assistant Examiner*—Denis E. Corr
*Attorney, Agent, or Firm*—Peter L. Berger

[57] ABSTRACT

A clip-on bookmark for finding a place in a book is disclosed wherein a substantially planar book marking member has two opposed covers with at least one edge portion with indicia, such as advertising message, associated with at least a portion of the covers. A slot is formed by the marking member along the edge portion and means for removably fastening the marking member to the book is received by the slot. The indicia may be imprinted directly onto the covers or may be contained on an item for receiving the indicia which is laminated to the covers, which may be of transparent, semi-rigid material, such as vinyl plastic. The covers may also form a pocket for removably holding a card on which the indicia is contained. The fastening member comprises oppositely positioned first and second legs joined at a reverse bend and form an open side opposite the reverse bend. The first leg is mounted in the slot and the second leg is positioned outside the marking member. The legs are spring biased one against the other so that when the spine of the book or pages of the book are inserted between the second leg and the marking member, the bookmark is held in position in part in the book by the bias action.

15 Claims, 19 Drawing Figures

FIG.5
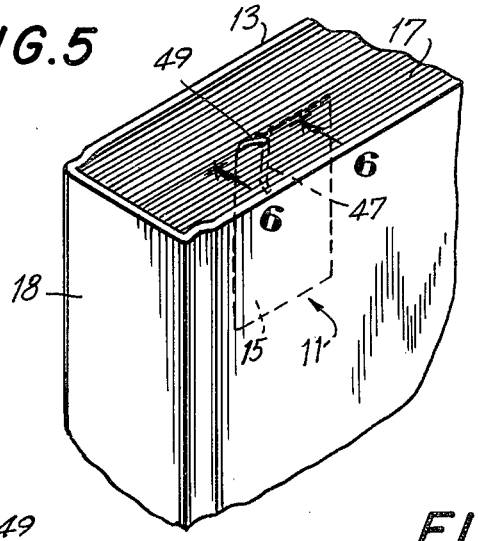
FIG.6
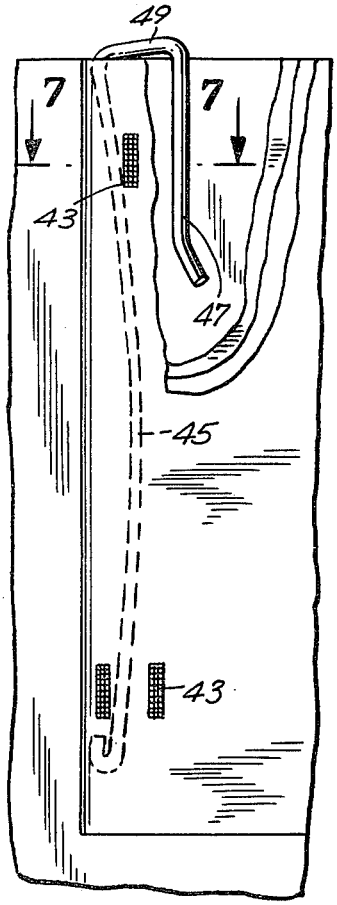
FIG.8
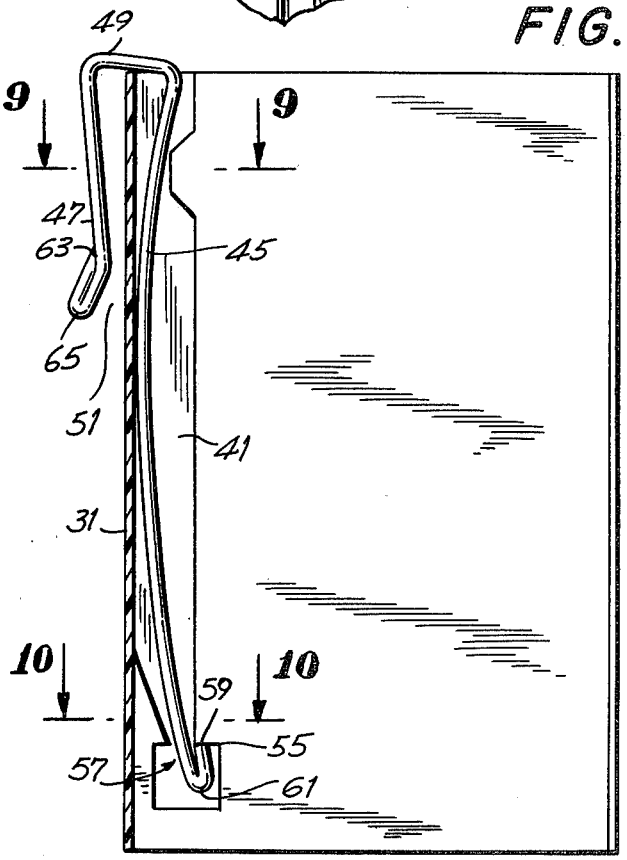
FIG.7
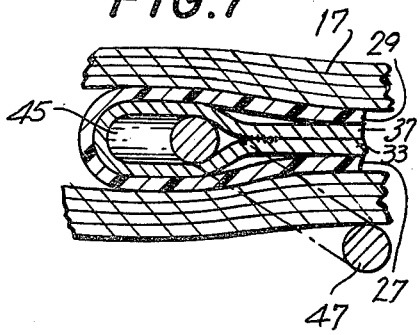
FIG.9
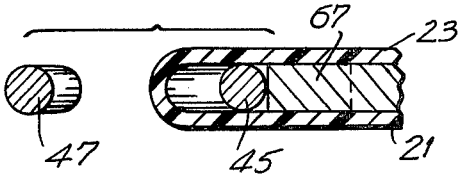
FIG.10
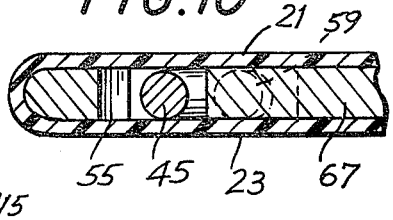
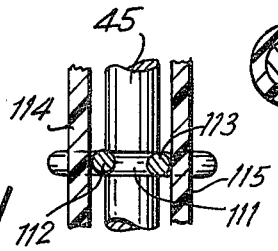
FIG.11

CLIP-ON BOOKMARK

BACKGROUND OF THE INVENTION

The subject invention relates to a clip-on bookmark that can be fastened onto the spine or pages of a book for finding a reading place. The bookmark portion can be used to display indicia such as advertising messages or business information.

In the prior art, bookmarks adapted to be held by a clip to books make no provision for containment of advertising, business cards, and the like.

My prior invention, "Apparatus for Holding, Reading and Handling Books", U.S. Pat. No. 4,072,407, discloses a bookmark with a pair of parallel slide members for attachment to the spine of a book with an auxiliary slide member for manual movement along the length of one of the slide members.

The subject invention is directed at the promotion of advertising by businesses, which would be able to use the clip-on bookmark for disseminating advertising, promotional, or informational messages of the type that would ordinarily go on an advertising card or flyer. The indicia contained by the clip-on bookmark would have the great advantage of being usable indefinitely and repeatedly.

BRIEF DESCRIPTION OF THE INVENTION

Accordingly, it is an object of the subject invention to provide a clip-on bookmark for attaching to the spine or pages of a book including indicia associated with the covers of a marking member that can be used repeatedly and indefinitely.

It is a further object of the subject invention to provide a clip-on bookmark that includes a book marking member having two transparent covers forming a pocket for receiving advertising material or a business card.

A further object of this invention is to provide such a bookmark which can also serve as a proper clip.

In accordance with these and many other objects, the subject invention provides for a clip-on bookmark for a book comprising a substantially planar marking member having two opposed covers and at least one edge portion, indicia associated with at least a portion of said covers, slot means formed by said marking member along said edge portion, and means received by said slot means for removably fastening said marking member to the book.

The clip-on bookmark further provides means for receiving the indicia where the covers are made of transparent material and the means for receiving tbe indicia is laminated to the portion of the covers associated with the indicia.

The clip-on bookmark also provides covers made of two transparent sheets that form a pocket means for removably holding the means for receiving the indica.

One embodiment of the subject invention is where the edge portion of the marking member defines a substantially straight first edge of the marking member where the marking member is a unitary portion comprising a first cover, a second cover opposed to the first cover and connected to the first cover along the first edge, a first inner fold positioned between the first and second covers along a second edge opposite and substantially parallel to the first edge, and a second inner fold positioned between the first fold and the second cover and connected to the first fold along a third edge adjacent and substantially parallel to the first edge, the second fold being attached to the first fold to form the slot, which is substantially parallel to the third edge.

The subject invention further provides a means for fastening that comprises oppositely positioned first and second legs joined at a reverse bend and having an open side opposite the reverse bend. The first leg is mounted in the slot means and the second leg is mounted outside the marking member. The legs are spring biased one against the other. Therefore, when the spine of the book is inserted between the second leg and the marking member, the marking member is held in position in part by the bias between the two legs.

The subject invention further provides a first leg that is rotatable within the slot means where the second leg can be rotated and where, when pages of the book are inserted between the second leg and the marking means, the marking member is held to the book in part by spring bias action between the two legs.

The fastening means or clip may be made of a flat metal strip, the flat sides of which bear against the inner surface of the slot means to maintain the fastening means in place, either in an outward or inward position. The slot may be made wide enough to accommodate the clip when folded inwardly, so that the bookmark can be conveniently carried in a wallet.

The first leg in the slot can be curved so that it is held in the slot in part by the force of the pressure of the first leg against the sides of the slot.

DESCRIPTION OF THE DRAWINGS

FIG. 5 is a perspective view of the bookmark clipped to the pages of a book.

FIG. 6 is a sectional side view of the bookmark taken along line 6—6 in FIG. 5.

FIG. 7 is a sectional side view of the bookmark taken along line 7—7 in FIG. 6.

FIG. 8 is a sectional side view of the bookmark with two transparent covers with the fastener having reverse bends at its ends.

FIG. 9 is a detailed sectional view taken along line 9—9 in FIG. 8.

FIG. 10 is a detailed sectional view taken along line 10—10 in FIG. 8.

FIG. 11 is a detailed sectional view of the bottom of the clip in the slot showing an alternate embodiment for retaining the clip in the slot.

DETAILED DESCRIPTION OF THE PREFERRED EMBODIMENTS

Figure 1:
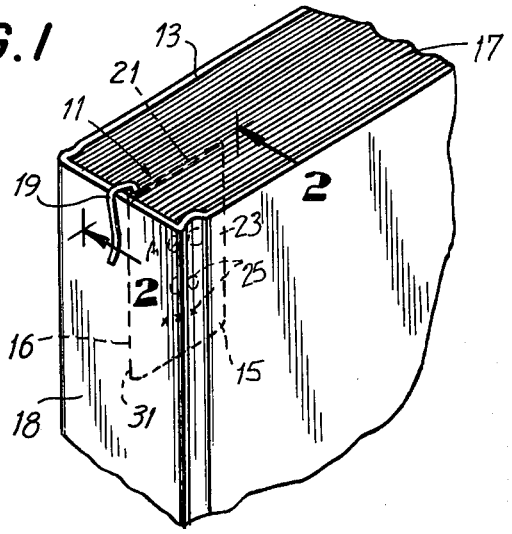
FIG. 1 is a perspective view of the clip-on bookmark shown clipped to the spine of a book.

The subject invention, clip-on bookmark 11, is illustrated in the perspective view of FIG. 1 as it is used to find a place in a book 13. Bookmark 11 comprises a substantially planar marking member 15, shown positioned between page 17 of the book marking the page last read by the reader, and a fastening means 19 mounted to member 15 along outside edge 16 for fastening the member to the book. Member 15 is shown for purposes of exposition as rectangular but it may of course have various configurations. Fastener or clip 19 is illustrated being clipped to the spine 18 of the book, but it may also be clipped to the pages of the book as will be described later. Member 15 includes two opposed covers 21 and 23. Visual material, or indicia, 25 is associated with either or both covers and can be observed by the reader when the book is opened and the bookmark is exposed. The indicia can be advertising matter, business information, symbols, designs, or any other such material as desired. Indicia is illustrated as indicated by X's on the covers in FIGS. 1 and 12. The indicia can be imprinted directly on covers 21 and 23, or, as will be described below, when the covers are of transparent, semirigid or resilient material such as vinyl plastic, the indicia may be laminated to the covers or inserted between the covers on a separate card.

Figure 14:
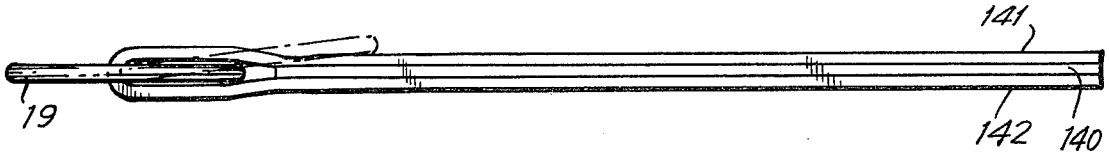
FIG. 14 is a top plan view of another embodiment of this invention in which a data card is held between the outer covers.

Additionally, a data card on a plurality of separate pages may be carried between the covers. This is more clearly shown in FIG. 14 which shows data card 140 fixedly attached along one edge to the covers 141 and 142 so as to be held therein. Still further, a plurality of separate pages may be carried between the covers by attaching the pages at their spine between the covers 141 and 142. The covers may be made of a thin metal or a metalized plastic to ensure long life and to provide protection for the material carried therebetween.

Figure 2:
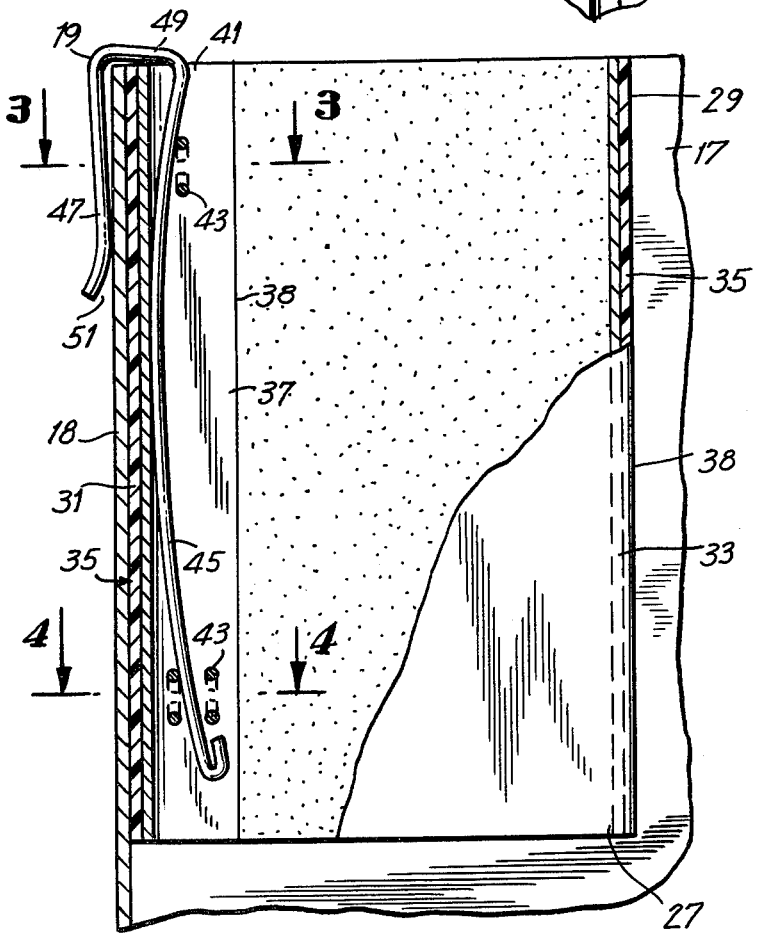
FIG. 2 is a sectional side view of the bookmark taken along line 2—2 in FIG. 1 with the marking member having four folds.
Figure 13:
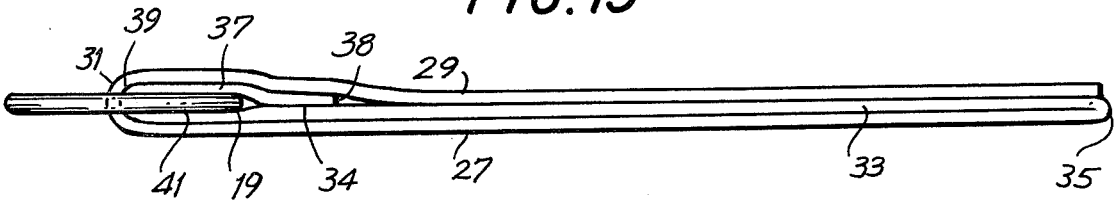
FIG. 13 is a top view of the four ply marking member illustrated in FIG. 2.

FIGS. 2 and 13 illustrate a preferred embodiment of the subject invention. Marking member 15 is shown as constructed from a unitary portion formed into four plys or layers. A first cover 27 and a second cover 29 are analogous to covers 21 and 23 in FIG. 1. Second cover 29 and is connected to it along substantially straight first edge 31, which is shown adjoining book spine 18. Cover 21 is positioned behind cover 23 in FIG. 1, and cover 29 is positioned behind cover 27 in the sectional view in FIG. 2; covers 21 and 29 are indicated by numerals at their edges. Covers 27 and 24 are illustrated in the top view of the marking member in FIG. 13. A first inner fold 33 is positioned between the first and second covers and is connected to the first cover along second edge 35, which is opposite and substantially parallel to first edge 31. A second inner fold 37 is positioned between first fold 33 and second cover 29 and is connected to first fold 33 along third edge 39, which is adjacent to and substantially parallel to first edge 31. Second fold 37 is a short fold ending at edge 39. Second fold 37 is attached to first fold 33 at connecting point 34 to form slot means 41 with outside edge 31, which is here the same as first edge 31. Slot means 41 is for mounting or holding fastening means 19 to marking member 15. Second fold 37 is attached to first fold 33 to form the slot means by means of staples 43, which are placed towards the top and bottom of the marking member, thus forming the channel or slot for containing the fastening means. The illustration in FIG. 2 has first cover 27 and first inner fold 33 removed showing only the staples that connect fold 37 to fold 33; fastening means or clip 19 is mounted in the position it assumes in relation to slot 41.

The unitary portion illustrated in FIG. 2 can be constructed all in one piece by cast or molded plastic or other suitable material and from a single sheet of semirigid material such as paper, cardboard, vinyl plastic, thin metal or metallized plastic by folding it into four sections, three of them approximately equal, namely first cover 27, adjacent second cover 29, and first inner fold 33 adjacent to first cover 27. Second inner fold 37, the remaining fourth section, which is adjacent to first fold 33, is only slightly wider than slot means 41. First fold 33 is laid across first cover 27 and second fold 35 is pressed against the first fold. Slot 41 is then formed by attaching second fold 37 to first fold 33 at the slot width generally parallel to edge 31 by means of staples, gluing, bonding, or any other suitable method. The inside of second cover 29 is then attached to the exposed adjacent sides of first and second folds 33 and 27 by gluing, bonding, or other such method. Thus a single bookmarker is formed.

Covers 27 and 29 analagous to first and second covers 33 and 37 can contain indicia directly imprinted on at least a portion of them or each may be made of transparent, semirigid or resilient material, such as vinyl plastic and have the indicia laminated to each of them.

Fastener means 19 is illustrated in FIG. 2 as first leg 45 and second leg 47, which are positioned opposite one another, that is, are coplanar, and substantially parallel to one another. As illustrated, legs 45 and 47 are cylindrical, that is, circular in cross-section, but other configurations will be described below. The two legs are joined at reverse bend 49 and also form open side 51 of the fastener substantially opposite bend 49. First leg 45, which is illustrated as being longer than leg 47 for purposes of exposition, is mounted in slot 41, and second leg 47 is mounted outside of marking member 15. In FIG. 2, leg 47 is shown clipped over book spine 18. Legs 45 and 47 are preferably spring biased one against the other, whereby when book spine 18 is inerted between second leg 47 and marking member 15, the bookmark 11 is held in position in the book in part by the force of the bias action between legs 45 and 47.

Figure 3:
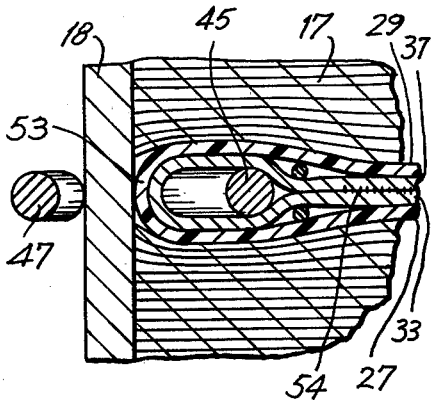
FIG. 3 is a detailed sectional view of the bookmark taken along line 3—3 in FIG. 2.

A detail of member 15 is illustrated in detail in FIG. 3 positioned between pages 17 of book 13. First leg 45 and second leg 47 are shown along with first and second covers 27 and 29 and first and second folds 33 and 37. Book spine 18 is located between leg 47 and marking member 15. First edge 31 and third edge 39 are shown adjacent to book spine 18. Slot 41, which holds leg 45, is formed in part by attachment of fold 33 to fold 37 via staple 43. Other attaching methods are of course possible.

Figure 4:
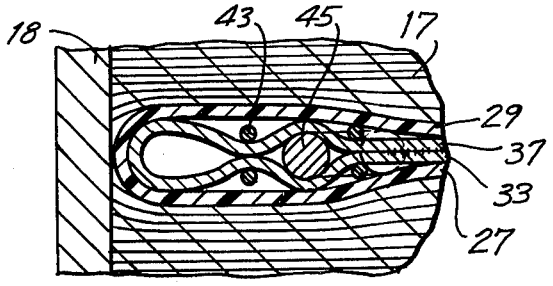
FIG. 4 is a detailed sectional view of the bookmark taken along line 4—4 in FIG. 2.

FIG. 4 further illustrates leg 45 within slot 41 but even further locked into position by staples 43 mounted on both sides of the leg, further aiding in keeping fastener 19 in position.

A variation of the subject invention is illustrated in FIG. 5, which shows marking member 15 positioned between the pages of the book with second leg 47 of fastener 41 rotated to a side position wherein the leg grips pages 17 of the book rather than the spine as shown in FIG. 1. To accomplish this position, leg 45 must be rotatable in slot 41. For this purpose, it is noted that leg 47 preferably be circular in cross-section.

Another embodiment of the subject invention is illustrated in FIG. 8. Here covers 21 and 23 are made of transparent material such as vinyl plastic with indicia 25 either laminated to the covers or imprinted directly onto the covers. Slot means 41 is shown formed by the two covers, exterior cover connecting portion 53 and interior connecting portion 54, which can be made of any suitable material for joining the two covers but is preferably of translucent material and joined to the covers by a suitable method such as heat bonding. Exterior connecting portion 53 is likewise preferably of clear vinyl plastic or similar transparent, semirigid material and heat bonded to covers 21 and 23.

FIG. 8 also illustrates a projecting portion 55, which is preferably round, that narrows slot 41 and neck 57. First leg 45 has first leg end 59 toward open side 51, and, with first reverse curve 61 at the first leg end, end 59 is swung toward closed reverse bend 49, thus tending to cause end 59 to catch against projecting portion 55 and thus to aid in keeping leg 45 in position in the slot. Leg 45 is shown as circular in cross-section, thus aiding in it rotatability, but it may be of another configuration in cross-section, such as rectangular.

Second leg 47 in another embodiment has leg end 63 turned away from second reverse curve 65 at open side 51. Because reverse curve 65 is smooth, it is less likely that leg end 63 will catch against the spindle or pages of the book.

FIG. 11 shows another embodiment for maintaining leg 45 in position in the slot. In particular, the lower part of leg 45 has an annular groove 111 formed therein which bears against retaining members 112–113 which are attached to the sides 114 and 115 of the slot. In this fashion, the leg 45 is prevented from riding up in the slot.

FIG. 9 illustrates details of legs 45 and 47 and covers 27 and 29 shown with connector 54 at outside edge 16. Filler 67 is preferably of transparent, semi-rigid material and fixed to covers 27 and 29 by a suitable method such as heat bonding to form a portion of the inner support means of slot 41, although other constructions are of course possible. Further details of legs 45 and 47 with filler 67 and projecting portion 55 are illustrated in FIG. 10.

Figure 12:
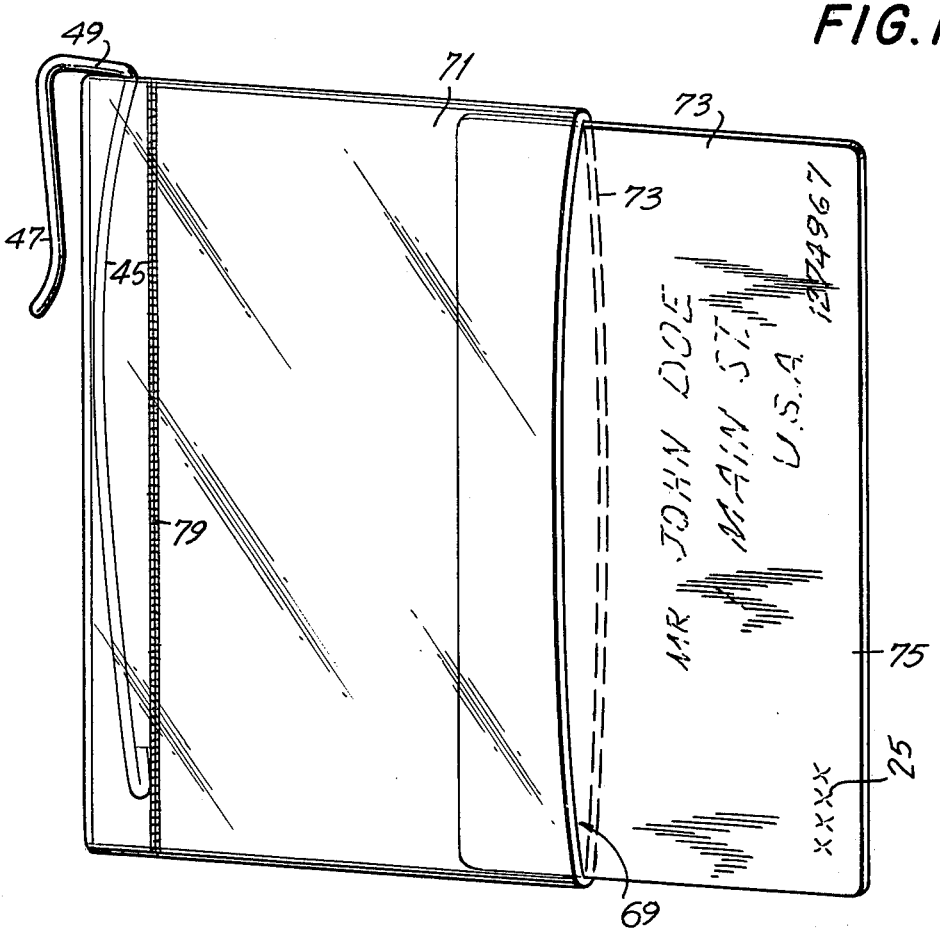
FIG. 12 is a perspective view of the bookmark having transparent covers forming a pocket for receiving indicia such as contained on an advertising card.

An embodiment of the subject invention with a slide-in pocket 69 formed by translucent material covers 71 and 73, analagous to covers 21 and 23 of FIG. 1, is illustrated in FIG. 12. Pocket 69 includes card entry means for receiving card 75, which has indicia 25 in the form of a business name and address or an advertising message, for example, contained on at least a portion of one or both of its sides. Fastening means 19 is contained in slot 41, which is sealed along slot edge 79 by any appropriate method such as heat bonding of covers 71 and 73. Outside edge 16 is likewise sealed to form the opposite side of slot 41.

Figure 15:
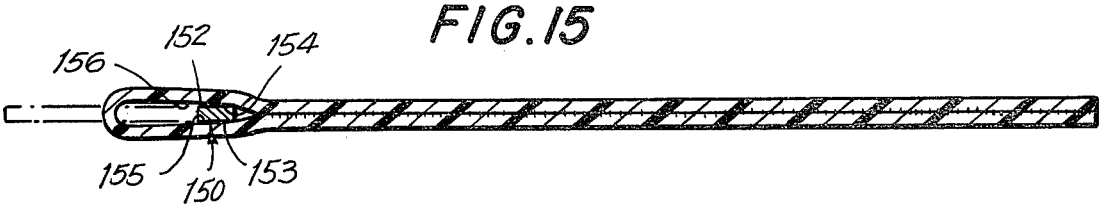
FIG. 15 is a top plan view in cross-section of another embodiment of this invention in which the clip member is made of a flat member.
Figure 16:
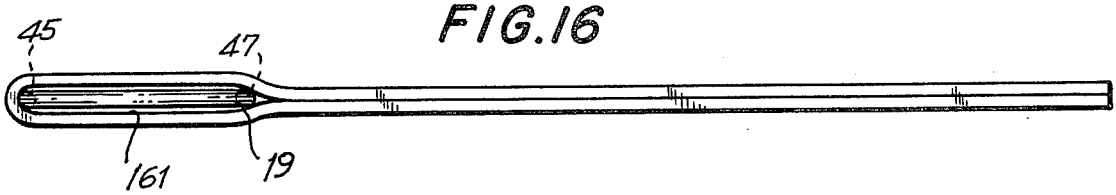
FIG. 16 is a top plan view of another embodiment of this invention in which the clip may be slipped within the slot portion of the bookmark of this invention.

FIGS. 15 and 16 illustrate other embodiments of this invention in which the clip 19 is made of a flat metal strip 150. Due to the flat side surfaces 152 and 153 of clip 19, the clip will be held in either its open or closed positions merely by the flat surfaces bearing against the flat inner surfaces 154 and 155 of slot 156. Clearly, rotating the clip is more difficult when a rectangular cross-section is used for the clip, but the clip is more fixedly held in its desired positions.

FIG. 16 shows the slot 161 being made large enough to accomodate the clip when it is not in use. The clip 19 is turned to its inward position, is slid upwardly to allow leg 47 to be above the top of the slot allowing the clip to be slid into the slot. This allows the bookmark to be conveniently carried in a wallet or the like with projecting ends of the clip being exposed.

Figure 17:
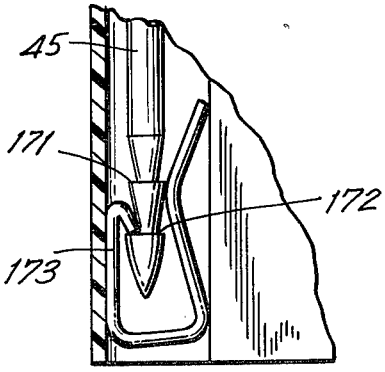
FIG. 17 is a sectional view of another embodiment of the lower portion of the clip member fastened within the slot.

FIG. 17 is a sectional view of another embodiment of the lower portion of leg 45 held in the slot. The lower portion comprises a plurality of barbs 171, 172 which fit into the mouth of an upwardly extending spring hook receptable 173 adapted to selectively lock onto one of the notches to prevent upward slippage of the clip.

Figure 18:
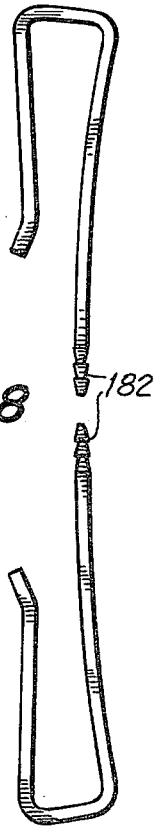
FIG. 18 is another embodiment of this invention in which the clip member comprises two double hook configurations.

FIG. 18 is a side sectional view of yet another embodiment of this invention in which the clip is provided as double sided 182. This enables the bookmark to be used by attaching the top or bottom clip to the clipped page without concern for ensuring that the bookmark is in its upright position. Additionally, use of the double hook configuration prevents the hook from sliding out from the slot when used with a springhook.

Figure 19:
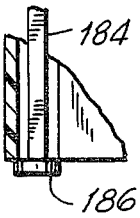
FIG. 19 is a sectional view of another embodiment of the lower portion of the clip member with an enlarged end protruding beyond the slot.

FIG. 19 is a side sectional view of yet another embodiment of this invention in which the clip 184 is provided with an enlarged end 184 so that it is inhibited from being withdrawn through the slot when in use.

In summary, there is provided a slip-on bookmark for marking a place in a book, the bookmark being capable of being slipped onto the spine or the pages of the book. The bookmark carries advertising or business messages or any other visual material that is inscribed directly onto the outer covers of the bookmark, is laminated to covers of transparent material or is imprinted onto a card that is insertable into a pocket formed by transparent covers of the bookmark. A data card or one or more pages may also be held between the covers.

The bookmark is aided in being held in position between the pages of the book by a fastening member or clip that is mounted in a slot on an edge portion of the book marking member, the slot being formed by the marking member itself. The fastening member preferably comprises an inner leg held in the slot and an outer leg outside the slot, the two legs being spring biased and joined at a reverse bend and having an open, unjoined portion at the opposite side. The spine of the book can be inserted between the outer leg and tbe marker, which is held to the book in part by bias action. Also, the inner leg can be allowed to rotate thus allowing the outer leg to swing to one side so that the pages of the book can be inserted between the outer leg and the marker thus aiding in holding the marker in the book. The clip may be made of a pin (circular cross-section) or a flat sheet (rectangular cross-section) of metal as described herein.

The inner leg of the fastening member can be curved to press against the side of the slot and aid in holding the bookmark in position. Also, the end of the inner leg can be curved so that the end of the leg is positioned to catch against a projecting portion of the slot so as to aid in holding the fastening means in position inside the slot. Several other embodiments are shown holding the slip in the slot. Additionally, staples can be used to clip the inner leg into position in the slot or notches can be employed. The slot for holding the fastening means has two substantially parallel sides located along the edge portion of the marker. The edge portion may be substantially straight or any other configuration. The sides of the slot are formed by any appropriate means, being stapled, heat bonded, or of one piece with the covers.

The clip may be flipped outwardly or inwardly. In its inward position, it may be stored in a wallet or the like, and an embodiment is illustrated in which the clip is hid within the slot. When it is in its inward position, it may be used as a paper clip when used apart from a book.

The clip-on bookmark allow messages to be displayed to the user many times, that is, each time the book is opened. In advertising material the repeat exposure is much greater than most other throw away forms of advertising. The clip-on bookmark is, in addition, very inexpensive in view of its repeat use potential. The outer covers may be made of a thin attractive metal, such as silver, brass or gold or as a metallized plastic.

Although the subject invention has been described in connection with preferred embodiments, it will be apparent to those skilled in the art that additions, modifications, and substitutions may be made without departing from the spirit and scope of the invention as defined by the appended claims.

I claim:

1. A clip-on bookmark for a book comprising a substantially planar marking member having two opposed covers and at least one edge portion, indicia associated with at least a portion of said covers, slot means formed by said marking member along said edge portion, and fastening means received by said slot means for removably fastening said marking member to the book, wherein said fastening means for fastening comprises a unitary member comprising oppositely positioned first and second legs joined at a reverse bend and having an open side opposite said reverse bend, said first leg being mounted in said slot means and said second leg being mounted outside said marking member, said legs being spring biased one against the other, whereby when the spine of the book is inserted between the second leg and the marking member, the marking member is held in position in part by bias action between the two legs, and said unitary member being shaped and rotatable about said slot means to move said second leg to an outer position to mark pages of the book and to an inner position to shield said second leg against said marking member, said second leg being alternatively resiliently biased toward one of said inner and outer positions, said slot means formed of a resilient plastic material extending along said edge portion, said first leg being inserted between the facing surfaces of said slot means bowing said facing surfaces to accommodate said first leg, said first leg comprising means to bear against said facing surfaces, said facing surfaces resiliently biased against said means to bear of said first leg to resiliently maintain said second leg in said inner and outer positions.

2. The bookmark claimed in claim 1, further including means for receiving said indicia and wherein said covers are made of transparent material and said means for receiving said indicia is laminated to said covers.

3. The bookmark claimed in claim 1, further including means for receiving said indicia and wherein said covers are two transparent sheets forming a pocket means for removably holding the means for receiving the indicia.

4. The bookmark claimed in claim 1, wherein said edge portion defines a first edge, wherein said marking member is a unitary portion comprising a first cover, a second cover opposed to said first cover and connected to said first cover along said first edge, a first inner fold positioned between said first and second covers and connected to said first cover along a second edge opposite and substantially parallel to said first edge, and a second inner fold positioned between said first fold and said second cover and connected to said first fold along a third edge adjacent and substantially parallel to said first edge, said second fold being attached to said first fold to form said slot, said slot being substantially parallel to said third edge.

5. The bookmark as claimed in claim 1, wherein said first leg is curved, said slot means comprises opposite facing sides whereby said first leg is held in said slot means in part by force of pressure of the first leg against the facing sides of the slot means.

6. The bookmark claimed in claim 1, wherein said first leg has a first end positioned in said slot means, said first leg having a first reverse curve at said first end wherein said first end is oriented toward said reverse bend, and wherein said slot means further includes a projecting portion adjacent to said first end, whereby the first leg is aided in being held in position in the slot means by catching action of the first end against the projecting portion.

7. The bookmark claimed in claim 1, wherein said second leg has a second end at said open side, said second leg having a second reverse curve at said second end, whereby said second reverse curve is smooth and less likely to catch against the pages or spine of the book.

8. The bookmark claimed in claim 5, wherein said fastening means comprises a substantially flat member.

9. The bookmark claimed in claim 5, wherein said fastening means comprises a cylindrical member having a substantially circular cross-section.

10. The bookmark claimed in claim 8, wherein said fastening means comprises a longer leg segment terminating in a plurality of notches, said slot comprising a barb which fits into at least one of said notches of said longer leg to hold said fastening means within said slot.

11. The bookmark claimed in claim 1, wherein said slot means comprises a width larger than said fastening means, whereby said fastening means may be hidden within said slot means.

12. The bookmark claimed in claim 1, wherein said bookmark further comprises at least a single sheet fastened between said covers.

13. The bookmark claimed in claim 12, wherein said bookmark further comprises a plurality of sheets fastened between said covers, said sheets being coextensive with said covers.

14. The bookmark claimed in claim 1, wherein said covers are made of a metal material.

15. The bookmark claimed in claim 1, wherein said fastening means comprises a double ended hook member, each end of said hook member cooperatively capable of holding said marking member to the book.

* * * * *